US007618692B2

(12) United States Patent
Nakano et al.

(10) Patent No.: US 7,618,692 B2
(45) Date of Patent: Nov. 17, 2009

(54) COATING LIQUID FOR RECORDING LAYER AND RECORDING MEDIUM

(75) Inventors: Ryoichi Nakano, Shizuoka-ken (JP); Takashi Kobayashi, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 502 days.

(21) Appl. No.: 10/978,733

(22) Filed: Nov. 2, 2004

(65) Prior Publication Data

US 2005/0100688 A1 May 12, 2005

(30) Foreign Application Priority Data

Nov. 6, 2003 (JP) ..... 2003-376690

(51) Int. Cl.
*B41M 5/40* (2006.01)

(52) U.S. Cl. ..... 428/32.34; 428/32.1; 428/32.37; 427/146; 427/337; 427/372.2

(58) Field of Classification Search ..... 428/32.1, 428/32.34, 32.37; 427/146, 337, 372.2
See application file for complete search history.

(56) References Cited

U.S. PATENT DOCUMENTS

| | | | | |
|---|---|---|---|---|
| 5,472,493 | A | 12/1995 | Regan | |
| 5,589,259 | A | 12/1996 | Hosoi et al. | |
| 6,420,039 | B1 | 7/2002 | Field et al. | |
| 2002/0171730 | A1 * | 11/2002 | Nakahara et al. | 347/105 |
| 2002/0176970 | A1 * | 11/2002 | Kobayashi et al. | 428/195 |
| 2003/0072923 | A1 * | 4/2003 | Sumioka et al. | 428/195 |
| 2003/0104175 | A1 * | 6/2003 | Koike et al. | 428/195 |
| 2003/0148048 | A1 * | 8/2003 | Yoshizawa et al. | 428/32.34 |
| 2007/0237911 | A1 * | 10/2007 | Nakano | 428/32.34 |
| 2008/0241437 | A1 * | 10/2008 | Nakano et al. | 428/32.34 |
| 2008/0241438 | A1 * | 10/2008 | Nakano et al. | 428/32.34 |

FOREIGN PATENT DOCUMENTS

| | | | |
|---|---|---|---|
| EP | 1 260 379 | A2 | 11/2002 |
| JP | 10-203006 | A | 8/1998 |
| JP | 10-217601 | A | 8/1998 |
| JP | 11-20306 | A | 1/1999 |
| JP | 2000-211235 | A | 8/2000 |
| JP | 2000-309157 | A | 11/2000 |

OTHER PUBLICATIONS

Anonymous: "Cab-O-Sil® MS -75D", Cabot Corporation, Online! 2002, XP002347598.

* cited by examiner

*Primary Examiner*—Bruce H Hess
*Assistant Examiner*—David J Joy
(74) *Attorney, Agent, or Firm*—Sughrue Mion, PLLC

(57) ABSTRACT

A coating liquid for a recording layer, containing fumed silica of a bulk density higher than 50 g/l and a specific surface area by the BET method equal to or higher than 250 $m^2/g$, and a recording medium having a recording layer prepared with such coating liquid. The recording layer contains a water-soluble resin, which is preferably crosslinked.

12 Claims, No Drawings

COATING LIQUID FOR RECORDING LAYER AND RECORDING MEDIUM

CROSS-REFERENCE TO RELATED APPLICATIONS

This application claims priority under 35 USC 119 from Japanese Patent Application No. 2003-376690, the disclosure of which is incorporated by reference herein.

BACKGROUND OF THE INVENTION

1. Field of the Invention

The present invention relates to a coating liquid for a recording layer, and a recording medium having a recording layer formed with such a coating liquid, such as an ink jet recording medium, a thermal recording medium, a pressure-sensitive recording medium, or a thermal transfer recording medium, and more particularly to a recording medium having an ink receptive layer.

2. Description of the Related Art

Along with the recent rapid progress of the information industry, various information processing systems have been developed, and recording methods and apparatuses suitable for such information processing systems have also been developed and brought into practical use. Among the aforementioned recording methods, the ink jet recording method is widely utilized not only in offices but also in homes, owing to advantages such as the ability to record on various recording media, hardware (devices) is relatively inexpensive, and ink-jet recording devices are compact and quiet.

Also responding to a recent increase in the resolution available with ink jet printers, various recording media have been developed to provide, for example, a high quality photo-like recording. For attaining high product value, the recording medium is required to have, in addition to an excellent ink absorbing property, satisfactory image storage stability after recording, that is, absence of image fading even with prolonged storage and an absence of any deterioration in image quality caused by blotting.

As a recording medium with an increased ink absorption, an ink jet recording sheet provided with an ink receptive layer having a three-dimensional structure with a high pore rate, formed with fine inorganic pigment particles such as fine silica particles and a water-soluble resin, is disclosed for example in JP-A Nos. 10-203006, 10-217601, 11-20306, 2000-309157, and 2000-211235 and is considered capable of forming an image of high resolution.

However, the fine inorganic pigment particles, such as the aforementioned fine silica particles, generally are extremely fine particles, and therefore have a strong interaction among themselves resulting in high viscosity and present difficulty in handling when the fine inorganic pigment particles are mixed in a dispersion medium such as water.

The present invention has been made in consideration of the aforementioned drawbacks. The present invention provides a coating liquid for a recording layer, having a low viscosity and therefore an excellent handling and also having high color density, high luster and a satisfactory ink offset resistance in an image formation, and also provides a recording medium having a recording layer made with such a coating liquid.

SUMMARY OF THE INVENTION

For attaining the aforementioned object, a first aspect of the present invention is to provide a coating liquid for a recording layer, including fumed silica of a bulk density higher than 50 g/l and a specific surface area by the BET method of 250 $m^2/g$ or higher.

A second aspect of the invention is to provide a recording medium having a recording layer, which includes fumed silica of a bulk density higher than 50 g/l and a specific surface area by the BET method of 250 $m^2/g$ or higher.

A third aspect of the invention is to provide a recording medium having a recording layer, characterized in that the recording layer is formed by hardening through crosslinking of a coated layer formed by coating a liquid for a recording layer (recording layer coating liquid), which includes at least fumed silica of a bulk density higher than 50 g/l and a specific surface area by the BET method of 250 $m^2/g$ or higher and a water-soluble resin, and the hardening through crosslinking is achieved by adding a crosslinking agent to the recording layer coating liquid and/or to a basic solution having a pH value of 7.1 or higher and by providing the coated layer with the basic solution either (1) simultaneously with the formation of the coated layer by coating of the recording layer coating liquid, or (2) in the course of drying of the coated layer formed by coating the recording layer coating liquid and before the coated layer shows a decreasing drying rate.

DETAILED DESCRIPTION OF THE INVENTION

In the present invention, a recording layer coating liquid and a recording layer such as an ink receptive layer for receiving an ink jet recording ink include fumed silica of a bulk density higher than 50 g/l and a specific surface area by the BET method of 250 $m^2/g$ or higher. The bulk density is more preferably higher than 50 g/l and equal to or less than 80 g/l, and in particular is preferably 60 to 80 g/l. Also the specific surface area is preferably 300 to 400 $m^2/g$, and in particular is preferably 300 to 380 $m^2/g$. The bulk density and the specific surface area meeting the aforementioned conditions produce a low viscosity in, and an excellent ease in liquid handling of a fumed silica dispersion and a recording layer coating liquid (recording layer coating liquid (A) to be explained later), and also provide a high color density and a high image luster during image formation on the recording layer, and also a satisfactory ink offset resistance (resistance to ink transfer when paper is brought into contact with an ink-deposited surface of the recording medium immediately after the ink deposition). In particular, the bulk density preferably does not exceed 80 g/l with respect to the luster.

The recording layer of the invention, such as an ink receptive layer, preferably includes a water-soluble resin, particularly a polyvinyl alcohol resin. The content of the water-soluble resin in the recording layer is preferably 9 to 40 mass % with respect to the solid (mass) of the layer, more preferably 12 to 33 mass %. A mass content ratio of the fumed silica particles (x) and the water-soluble resin (y) [PB ratio (x/y)] is preferably 1.5 to 10, more preferably 2 to 5.

In a case where the recording layer of the invention includes a water-soluble resin, a crosslinking agent is preferably contained for crosslinking the water-soluble resin. A boron compound is preferable as the crosslinking agent for the water-soluble resin, particularly for the polyvinyl alcohol resin.

(Recording Layer Coating Liquid)

The recording layer coating liquid of the invention at least includes fumed silica having a bulk density higher than 50 g/l and a specific surface area by the BET method equal to or higher than 250 $m^2/g$. The recording layer to be formed with such a coating liquid is preferably a layer for forming a recording by receiving an ink therein (ink receptive layer), but is not restricted to this manner.

In the invention, in addition to fumed silica, there can also be employed fine particles of titanium dioxide, barium sulfate, calcium silicate, zeolite, caolinite, halloysite, mica, talc, calcium carbonate, magnesium carbonate, calcium sulfate, zinc oxide, zinc hydroxide, alumina, aluminum silicate, calcium silicate, magnesium silicate, zirconium oxide, zirconium hydroxide, cerium oxide, lanthanum oxide or yttrium oxide.

Also in the preparation of a dispersion of fumed silica particles, a cationic resin is preferably employed as a dispersant.

Fine silica particles are generally classified, by the producing method thereof, into wet process particles and dry process (gas phase process) particles, with the fumed silica in the invention being dry process (gas phase process) particles. The gas phase process is principally a process involving gas-phase hydrolysis of a silicon halide at a high temperature (flame hydrolysis process) or a process that involves reducing and gasifying silica sand and cokes under heating by an arc in an electric furnace followed by air oxidation (arc process), thereby obtaining anhydrous silica. "Fumed silica" means fine anhydrous silica particles obtained by such a gas-phase process. The aforementioned wet process is principally a process that involves generating active silica by acidolysis of a silicate salt and agglomerating and precipitating the active silica through an appropriate polymerization to obtain hydrous silica, which may also be employed in combination with fumed silica.

The fumed silica is different from hydrous silica in the surface concentration of silanol groups, presence/absence of pores, etc., and thus shows properties different therefrom, and is suitable for forming a three-dimensional structure with a high pore rate. The reason therefor is not clear, but it is supposed that hydrous silica tends to form a dense agglomerate (aggregate) of silica particles due to a silanol group density as high as 5-8/nm$^2$ at the particle surface, while the fumed silica tends to form a less dense and soft agglomerate (flocculate) due to a silanol group density as low as 2-3/nm$^2$ at the particle surface, and as a result a structure with a high pore rate is formed.

The fumed silica, having a very high specific surface area, shows a high ink absorbing property and a high ink holding property, and, having a low refractive index, can provide the ink receptive layer with a transparency when dispersed and brought to an appropriate particle size, thereby realizing a high color density and a satisfactory color developing property. A transparency of the ink receptive layer is important for realizing a high color density, and satisfactory color developing property, and luster, also for such applications as photographic glossy paper.

The fumed silica preferably has an average primary particle size of 20 nm or less, more preferably 10 nm or less and particularly has preferably 3 to 10 nm. As the fumed silica particles tend to become stuck together due to hydrogen bonding of the silanol groups, an average primary particle size of 20 nm or less allows formation of a structure with a high pore rate, thereby effectively improving the ink absorbing property and also improving the transparency and the surface luster of the ink receptive layer. The fumed silica may be employed while in the state of being primary particles or may be included while in a state of forming secondary particles.

The fumed silica particles mentioned above may be employed in an ink jet recording medium, in manners described for example in JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314.

Also for the purpose of improving dispersibility, surfaces of the fumed silica particles may be treated with a silane coupling agent. Such silane coupling agent preferably includes, in addition to a part for effecting the coupling treatment, a functional organic group (such as a vinyl group, an amino group, an epoxy group, a mercapto group, a chloro group, an alkyl group, a phenyl group, or an ester group).

<Fumed Silica Particle Dispersion>

The fumed silica particles are preferably prepared in an aqueous dispersion of the particles by a dispersing process. The aqueous particle dispersion can be obtained by preparing an aqueous dispersion containing the fumed silica particles and a dispersant by a method, for example, of dispersing the fumed silica particles in water and adding an aqueous dispersant solution thereto (fumed silica particles dispersed in water may be added to an aqueous dispersant solution, or both may be mixed at the same time), or a method, for example, of utilizing fumed silica particles in a powder state instead of the fumed silica particles dispersed in water in each of the foregoing methods, and then applying a dispersing process to the aqueous dispersion. For the dispersing process, known dispersing apparatuses can be used such as a high-speed rotation disperser, a medium-agitation type disperser (a ball mill or a sand mill), an ultrasonic disperser, a colloid mill disperser, a roll mill disperser, or a high-pressure disperser. To effectively disperse globules formed from the particles, an ultrasonic disperser or a high-pressure disperser is preferable.

In the preparation of the fumed silica particle dispersion, various additives may be added. Examples of the additives include a nonionic or cationic surfactant (an anionic surfactant being not preferable due to agglomerate formation), a defoamer, a nonionic hydrophilic polymer (such as polyvinyl alcohol, polyvinylpyrrolidone, polyethylene oxide, polyacrylamide, sugars, gelatin, or pullulan), a nonionic or cationic latex dispersion, a water-miscible organic solvent (such as ethyl acetate, methanol, ethanol, isopropanol, n-propanol, or acetone), an inorganic salt, and a pH regulating agent, which may be suitably used as needed.

In particular, a water-miscible organic solvent is preferable for suppressing formation of small globules when the fumed silica particles and the following cationic resin are mixed. The water-miscible organic solvent is employed in an amount of 0.1 to 20 mass % in the dispersion, preferably 0.5 to 10 mass %.

A pH value when preparing the dispersion of the fumed silica particles is widely variable depending on, for example, the type of fumed silica particles, the type of cationic resin and the additives, but is generally within a range of 1 to 8, preferably 2 to 7. The aforementioned dispersant may be employed in a combination of two or more kinds.

In a recording layer coating liquid of the invention, the content of the fumed silica particles preferably is 5 to 15 mass %, more preferably 6 to 13 mass %.

(Cationic Resin)

In the preparation of the fumed silica particle dispersion, a cationic resin is preferably employed as a dispersant. This resin also has a mordant function for an ink (dye). The cationic resin is not particularly restricted, but is preferably a cationic polymer having a primary to tertiary amino group or a salt thereof, or a quaternary ammonium salt group, including examples of the mordant to be explained later. It is also preferable to employ a silane coupling agent as the dispersant.

More specifically, a cationic resin of a water-soluble type or aqueous emulsion type can be advantageously employed. For example, a polycationic cation resin can be employed, such as a dicyan cationic resin represented by a dicyanamide-formalin polycondensate, a polyamine cationic resin represented by a dicyanamide-diethylenetriamine polycondensate, an epichlorhydrin-dimethylamine addition polymer, a dimethyldiallylammonium chloride-$SO_2$ copolymer, a diallylamine salt-$SO_2$ copolymer, a dimethyldiallylammonium chloride polymer, an allylamine salt polymer, a dialkylaminoethyl (meth)acrylate quaternary salt polymer, or an acrylamide-diallylamine salt copolymer. Among these, dimethyldiallylammonium chloride, monomethyldiallylammonium chloride and polyamidine are preferable, with dimethyldiallylammonium chloride and monomethylammonium chloride being particularly preferable for water resistance. The cationic resin may be employed singly or in a combination of two or more kinds.

The amount of the cationic resin to be added in the recording layer such as an ink receptive layer is preferably 1 to 10 mass % with respect to the fumed silica particles, more preferably 1 to 5 mass %. An added amount of less than 1 mass % may result in inferior dispersibility, while an amount exceeding 10 mass % may lower the color density during image formation. The cationic resin may be added in a small amount prior to crushing and dispersion, then crushed and dispersed to bring it to a desired particle size, and thereafter may be further added.

(Water-Soluble Resin)

The recording layer of the invention, such as an ink receptive layer, preferably includes a water-soluble resin.

The water-soluble resin can for example be a polyvinyl alcohol resin having a hydroxyl group as a hydrophilic structural unit [such as polyvinyl alcohol (PVA), acetacetyl-denatured polyvinyl alcohol, cation-denatured polyvinyl alcohol, anion-denatured polyvinyl alcohol, silanol-denatured polyvinyl alcohol, or polyvinyl acetal], a cellulose resin [such as methyl cellulose (MC), ethyl cellulose (EC), hydroxyethyl cellulose (HEC), carboxymethyl cellulose (CMC), hydroxypropyl cellulose (HPC), hydroxyethylmethyl cellulose, or hydroxypropylmethyl cellulose], a chitin, a chitosan, starch, a resin having an ether bond [such as polyethylene oxide (PEO), polypropylene oxide (PPO), polyethylene glycol (PEG), or polyvinyl ether (PVE)], or a resin having a carbamoyl group [such as polyacrylamide (PAAM), polyvinylpyrrolidone (PVP) or polyacrylatehydrazide]. There can also be employed a polyacrylate salt, a maleate resin, an alginate salt or a gelatin, having a carboxyl group as a dissociable group.

Among these, the type of the water-soluble resin to be combined with the fumed silica particles is important when considering factors including the transparency of the layer and the coating property, with polyvinyl alcohol resin being particularly preferable.

Examples of the polyvinyl alcohol include those described in JP-B Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080, and 9-39373, Japanese Patent No. 2750433, JP-A Nos. 2000-158801, 2001-213045, 2001-328345, 8-324105 and 11-348417.

Among these, the saponification degree is preferably 90% or higher, more preferably 95% or higher. A saponification degree less than 90% results in a high viscosity in the coating liquid for forming the ink receptive layer, thus rendering coating difficult and hindering the layer formation.

The polyvinyl alcohol resin has a hydroxyl group in a structural unit thereof, and the hydroxyl group forms a hydrogen bond with a surface silanol group of the fumed silica, thereby promoting formation of a three-dimensional network structure in which secondary particles of the silica particles constitute a network chain unit. Formation of such a three-dimensional network structure is considered to produce an ink receptive layer with a porous structure having a high pore rate and a sufficiently high strength. An ink receptive layer having the aforementioned porous structure can rapidly absorb ink by capillary action and can form an ink dot with satisfactory circularity without ink blotting.

The water-soluble resin may be employed singly or in a combination of two or more kinds. In the recording layer such as the ink receptive layer, the content of the water-soluble resin is preferably 9 to 40 mass % with respect to a solid (mass) of the layer, more preferably 12 to 33 mass %.

In combination with the polyvinyl alcohol resin, there may be employed another of the aforementioned water-soluble resins. In a case of such combined use, the content of the polyvinyl alcohol resin is preferably 50 mass % or more of the entire water-soluble resin, more preferably 70 mass % or more.

<Content Eatio of Fumed Silica Particles and Water-Soluble Resin>

The mass content ratio of the fumed silica particles (x) and the water-soluble resin (y) [PB ratio (x/y)] also significantly influences the film structure and the film strength of the recording layer such as the ink receptive layer. More specifically, an increase in the mass content ratio [PB ratio] increases the pore rate, pore volume, and surface area (per unit mass), but tends to lower the density and strength. The PB ratio is preferably within a range of 1.5 to 10, in order to prevent a reduced film strength and a cracking when drying resulting from an excessively large PB ratio, and also to prevent a loss in the ink absorbing property resulting from an excessively small PB ratio, which tends to close the pores with the resin and thereby reduce the pore rate.

The ink receptive layer is required to have sufficient film strength, as the recording sheet may be subjected to stress when passing through the conveying system of an ink jet printer. The ink receptive layer is required to have a sufficient film strength also for preventing cracking or peeling thereof when cutting into sheets. In consideration of these factors, the PB ratio (x/y) is more preferably 5 or less, and more preferably 2 or more to maintain a high-speed ink absorbing property with an ink jet printer.

For example, when coating a substrate with a coating liquid, in which fumed silica particles of an average primary particle size of 20 nm or less and a water-soluble resin are completely dispersed in an aqueous solution with a PB ratio (x/y) of 2 to 5, and then drying this coated layer, there is formed a three-dimensional network structure in which the secondary particles of the silica particles constitute a network chain, whereby a translucent porous film can be easily formed with an average pore size of 30 nm or less, a pore rate of 50-80%, a specific pore volume of 0.5 ml/g or higher, and a specific surface area of 100 $m^2/g$ or more.

(Crosslinking Agent)

In a case where the recording layer of the invention such as the ink receptive layer includes a water-soluble resin, it is preferable that a crosslinking agent for crosslinking the water-soluble resin be contained.

A boron compound is preferable for crosslinking the aforementioned water-soluble resin, particularly for a polyvinyl alcohol resin. Examples of the boron compound include borax, boric acid, aborate salt (such as an orthoborate salt, $InBO_3$, $ScBO_3$, $YBO_3$, $LaBO_3$, $Mg_3(BO_3)_2$, $Co_3(BO_3)_2$), a diborate salt (such as $Mg_2B_2O_5$ or $CO_2B_2O_5$), a metaborate salt (such as $LiBO_2$, $Ca(BO_2)_2$, $NaBO_2$, or $KBO_2$), a tetraborate salt (such as $Na_2B_4O_7.10H_2O$), and a pentaborate salt (such as $KB_5O_8.4H_2O$, $Ca_2B_6O_{11}.7H_2O$ or $CsB_5O_5$). Among these, borax, boric acid or a borate salt is preferable for inducing the crosslinking reaction promptly, particularly boric acid.

It is also possible to utilize any of the following compounds other than the boron compound. Examples of usable compounds include an aldehyde compound such as formaldehyde, glyoxal or glutar aldehyde; a ketone compound such as diacetyl or cyclopentadione; an active halogen compound such as bis(2-chloroethylurea)-2-hydroxy-4,6-dichloro-1,3,5-triazine, or sodium 2,4-dichloro-6-S-triazine; an active vinyl compound such as divinylsulfonic acid, 1,3-vinylsulfonyl-2-propanol, N,N'-ethylenebis(vinylsulfonylacetamide) or 1,3,5-triacryloyl-hexahydro-S-triazine; an N-methylol compound such as dimethylolurea or methyloldimethylhidantoin; a melamine resin (such as methylolmelamine or alkylated methylolmelamine); an epoxy resin; an isocyanate compound such as 1,6-hexamethylenediisocyanate; an aziridine compound as described in U.S. Pat. Nos. 3,017,280 and 2,983,611; a carboxyimide compound described in U.S. Pat. No. 3,100,704; an epoxy compound such as glycerol triglycidyl ether; an ethyleneimino compound such as 1,6-hexamethylene-N,N'-bisethyleneurea; a halogenated carboxyaldehyde compound such as mucochloric acid or mucophenoxychloric acid; a dioxane compound such as 2,3-dihydroxydioxane; a metal-containing compound such as titanium lactate, aluminum sulfate, chromium alum, potassium alum, zirconyl acetate, or chromium acetate; a polyamine compound such as tetraethylene pentamine; a hydrazide compound such as adipate dihydrazide; and a low molecular compound or a polymer containing two or more oxazoline groups. The aforementioned crosslinking agents may be employed singly or in a combination of two or more kinds.

The crosslinking agent may be added, at the coating of the coating liquid for forming the recording layer such as the ink receptive layer, to the recording layer coating liquid and/or to a coating liquid for forming a layer adjacent to the recording layer. The crosslinking agent otherwise may be provided to the recording layer, for example, by coating the aforementioned recording layer coating liquid on a substrate which has been coated in advance with a coating liquid containing the crosslinking agent, or, as another example, by overcoating a solution of the crosslinking agent after having coated and dried the recording layer coating liquid, which does not contain the crosslinking agent. In consideration of production efficiency, it is preferable to add the crosslinking agent to the recording layer coating liquid or to a coating liquid for forming an adjacent layer, thereby providing the crosslinking agent simultaneously with the formation of the recording layer.

As an example, the crosslinking agent can be advantageously provided in the following manner. A boron compound will be taken as an example. In a case where the recording layer such as an ink receptive layer is formed by hardening through crosslinking of a coated layer formed by coating a recording layer coating liquid (A), the hardening through crosslinking is attained by providing the coated layer with a basic solution having a pH value of 7.1 or higher (coating liquid (B)) either (1) simultaneously with the formation of the coated layer formed by the coating of the recording layer coating liquid (A), or (2) in the course of drying of the coated layer formed by the coating of the recording layer coating liquid (A) and before the coated layer shows a decreasing drying rate.

The boron compound constituting the crosslinking agent may be contained either in the recording layer coating liquid (A) or the coating liquid (B), or may be added to both the recording layer coating liquid (A) and the coating liquid (B).

The crosslinking agent is employed preferably in an amount of 1 to 50 mass % with respect to the water-soluble resin in the layer, more preferably 5 to 40 mass %.

(Mordant)

The ink receptive layer of the invention preferably includes a mordant for further improving the time-dependent blotting of the formed image and water resistance. The mordant is preferably an organic mordant such as a cationic polymer (cationic mordant), or an inorganic mordant such as a water-soluble metal compound. The mordant present in the ink receptive layer causes an interaction with a liquid ink containing an anionic dye as a colorant to stabilize the dye, thereby providing an image of high density and improving the time-dependent blotting, water resistance, and other aspects.

When added to the coating liquid (B), the mordant is present mostly in the vicinity of the surface of the ink receptive layer, whereby the colorant of the ink can be sufficiently mordanted to improve the water resistance of language characters or images after printing. A part of the mordant may be contained in the recording layer coating liquid (A), and, in which case, the mordant in the recording layer coating liquid (A) and that in the coating liquid (B) may be the same or different.

As the aforementioned cationic mordant, there can be advantageously employed a polymer mordant having a primary to tertiary amino group or a quaternary ammonium salt group as a cationic functional group, but a cationic non-polymer mordant can also be employed.

As the aforementioned polymer mordant, there is preferred a single polymer of a monomer (mordant monomer) having a primary to tertiary amino group or a salt thereof, or a quaternary ammonium salt group, or a copolymer or a polycondensate of such mordant monomer and another monomer (non-mordant monomer). Such a polymer mordant may be used in a state of either a water-soluble polymer or water-dispersed latex particles.

The mordant monomer can be, for example, trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n-propyl-N-p-vinylbenzyl ammonium chloride, N,N-dimethyl-N-n-octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl)benzyl-N-p-vinylbenzyl ammonium chloride, N,N-dimethyl-N-phenyl-N-p-vinylbenzyl ammonium chloride;

trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl) ethyl ammonium chloride, N,N-diethyl-N-methyl-N-2-(4-vinylphenyl)ethyl ammonium acetate;

N,N-dimethylaminoethyl (meth)acrylate, N,N-diethylaminoethyl (meth)acrylate, N,N-dimethylaminopropyl (meth) acrylate, N,N-diethylaminopropyl (meth)acrylate, N,N-dimethylaminoethyl (meth)acrylamide, N,N-diethylaminoethyl (meth)acrylamide, N,N-dimethylaminopropyl (meth)acrylamide, or N,N-diethylaminopropyl (meth)acrylamide, formed into a quaternary compound with methyl chloride, ethyl chloride, methyl bromide, ethyl bromide, methyl iodide or ethyl iodide, or a sulfonate salt, an alkylsulfonate salt, an acetate salt or an alkylcarboxylate salt formed by substituting an anion thereof.

Examples of specific compounds include monomethyldiallyl ammonium chloride, trimethyl-2-(methacryloyloxy) ethyl ammonium chloride, triethyl-2-(methacryloyloxy)ethyl ammonium chloride, trimethyl-2-(acryloyloxy)ethyl ammonium chloride, triethyl-2-(acryloyloxy)ethyl ammonium chloride, trimethyl-3-(methacryloyloxy)propyl ammonium chloride, triethyl-3-(methacryloyloxy)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, triethyl-3-(methacryloylamino)propyl ammonium chloride, trimethyl-3-(acryloylamino)propyl ammonium chloride, triethyl-3-(acryloylamino)propyl ammonium chloride;

N,N-dimethyl-N-ethyl-2-(methacryloyloxy)ethyl ammonium chloride, N,N-diethyl-N-methyl-2-(methacryloyloxy)ethyl ammonium chloride, N,N-dimethyl-N-ethyl-3-(acryloylamino)propyl ammonium chloride, trimethyl-2-(methacryloyloxy)ethyl ammonium bromide, trimethyl-3-(acryloylamino)propyl ammonium bromide, trimethyl-2-(methacryloyloxy)ethyl ammonium sulfonate, and trimethyl-3-(acryloylamino)propyl ammonium acetate.

Other copolymerizable monomers include N-vinylimidazole, and N-vinyl-2-methylimidazole.

There can also be utilized allylamine, diallylamine, a derivative thereof or a salt thereof. Examples of such compounds include allylamine, allylamine hydrochlorate salt, allylamine acetate salt, allylamine sulfate salt, diallylamine, diallylamine hydrochlorate salt, diallylamine acetate salt, diallylamine sulfate salt, diallylmethylamine and a salt thereof (such as a hydrochlorate salt, an acetate salt, or a sulfate salt), diallylethylamine and a salt thereof (such as a hydrochlorate salt, an acetate salt, or a sulfate salt), and diallyldimethyl ammonium salt (a counter anion thereof being for example chloride, acetate ion, or sulfate ion). Such derivatives of allylamine or diallylamine, showing an inferior polymerizing property in an amine state, are generally prepared by polymerization in a salt state, followed by desalting if necessary.

It is also possible to employ a polymerization unit such as N-vinylacetamide or N-vinylformamide and execute hydrolysis after polymerization to form a vinylamine unit, and to use a salt formed from this product.

The non-mordant monomer means a monomer which does not have a basic or cationic portion such as a primary to tertiary amino group or a salt thereof, or a quaternary ammonium salt group, and which is free from or substantially free from an interaction with a dye in an ink jet recording ink.

The non-mordant monomer can be, for example, a (meth) acrylate alkyl ester; a (meth)acrylate cycloalkyl ester such as cyclohexyl (meth)acrylate; a (meth)acrylate aryl ester such as phenyl (meth)acrylate; an aralkyl ester such as benzyl (meth) acrylate; an aromatic vinyl compound such as styrene, vinyltoluene, or α-methylstyrene; a vinyl ester such as vinyl acetate, vinyl propionate, or vinyl versatate; an allyl ester such as allyl acetate; a halogen-containing monomer such as vinylidene chloride or vinyl chloride; a cyanated vinyl compound such as (meth)acrylonitrile; or an olefin such as ethylene or propylene.

The (meth)acrylate alkyl ester preferably has 1 to 18 carbon atoms in an alkyl portion, and can specifically be methyl (meth)acrylate, ethyl (meth)acrylate, propyl (meth)acrylate, isopropyl (meth)acrylate, n-butyl (meth)acrylate, isobutyl (meth)acrylate, t-butyl (meth)acrylate, hexyl (meth)acrylate, octyl (meth)acrylate, 2-ethylhexyl (meth)acrylate, lauryl (meth)acrylate, or stearyl (meth)acrylate. Among these, methyl acrylate, ethyl acrylate, methyl methacrylate, ethyl methacrylate or hydroxyethyl methacrylate is preferred. Such non-mordant monomer may be employed singly or in a combination of two or more kinds.

Also as the aforementioned polymer mordant, there is preferred polydiallyldimethyl ammonium chloride, polymethacryloyloxyethyl-β-hydroxyethyldimethyl ammonium chloride, polyethyleneimine, polyallylamine or a derivative thereof, a polyamide-polyamine resin, cationized starch, a dicyandiamide form a line condensate, a dimethyl-2-hydroxypropyl ammonium salt polymer, polyamidine, polyvinylamine, a dicyan cationic resin represented by a dicyandiamide-formalin polycondensate, a polyamine cationic resin represented by a dicyanamide-diethylenetriamine polycondensate, an epichlorhydrin-dimethylamine addition polymer, a dimethyldiallyl ammonium chloride-$SO_2$ copolymer, or a diallylamine salt-$SO_2$ copolymer.

Specific examples of the polymer mordant include those described in JP-A Nos. 48-28325,54-74430, 54-124726, 55-22766, 55-142339, 60-23850, 60-23851, 60-23852, 60-23853, 60-57836, 60-60643, 60-118834, 60-122940, 60-122941, 60-122942, 60-235134 and 1-161236, U.S. Pat. Nos. 2,484,430, 2,548,564, 3,148,061, 3,309,690, 4,115,124, 4,124,386, 4,193,800, 4,273,853, 4,282,305 and 4,450,224, JP-A Nos. 1-161236, 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314. Among these, polyallylamine and a derivative thereof are particularly preferred.

The inorganic mordant can be a water-soluble salt of a polyvalent metal, or a hydrophobic metal salt, for example a salt or a complex of a metal selected from magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten, and bismuth.

Specific examples include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidesulfate tetrahydrate, aluminum sulfate, aluminum alum, basic polyaluminum hydroxide, aluminum sulfite, aluminum thiosulfate, polyaluminum chloride, aluminum nitrate nonahydrate, aluminum chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, titanium tetrachloride, tetraisopropyl titanate, titanium acetylacetonate, titanium lactate, zirconium acetylacetonate, zirconyl acetate, zirconyl sulfate, zirconium ammonium carbonate, zirconyl stearate, zirconyl octylate, zirconyl nitrate, zirconium oxychloride, zirconium hydroxychloride, chromium acetate, chromium sulfate, magnesium sulfate, magnesium chloride hexahydrate, magnesium citrate nonahydrate, sodium phosphotungstate, sodium tungsten citrate, 12-tungstophosphoric acid n-hydrate, 12-tungstosilicic acid 26-hydrate, molybdenum chloride, 12-molybdophosphoric acid n-hydrate, potassium nitrate, manganese acetate, germanium nitrate, strontiumnitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride and bismuth nitrate.

Among these inorganic mordants, an aluminum-containing compound, a titanium-containing compound, a zirconium-containing compound, or a compound (salt or complex) of a metal of the IIIB series of the periodic table are preferable.

A content of the mordant in the ink receptive layer is preferably 0.01 to 5 g/m$^2$, more preferably 0.1 to 3 g/m$^2$.

—Other Components—

The recording layer coating liquid of the invention may further contain, if necessary, various known additives such as an acid, an ultraviolet absorber, an antioxidant, a fluorescent whitening agent, a monomer, a polymerization initiator, a polymerization inhibitor, an antiblotting agent, an antiseptic, aviscosity stabilizer, a defoamer, a surfactant, an antistatic agent, a matting agent, an anticurl agent, a water resistance agent, etc.

The recording layer of the invention, such as the ink receptive layer, may contain an acid. A surface pH of the ink receptive layer adjusted to 3 to 8, preferably 5 to 7.5, by addition of an acid allows improvement of resistance to yellowing in a white background area. The surface pH can be measured the "A" method (coating method) found among various methods for surface pH measurement defined by the Japan Technical Association for Paper and Pulp Industries (J. TAPPI). For example, a MPC-model surface pH measurement set, manufactured by Kyoritsu Rikagaku Kenkyusho, corresponds to the aforementioned "A" method and can be used.

Specific examples of the acid include formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, glutaric acid, gluconic acid, lactic acid, aspartic acid, glutamic acid, salicylic acid, metal salicylate (such as Zn, Al, Ca or Mg salt), methanesulfonic acid, itaconic acid, benzenesulfonic acid, toluenesulfonic acid, trifluoromethanesulfonic acid, styrenesulfonic acid, trifluoroacetic acid, barbituric acid, acrylic acid, methacrylic acid, cinnamic acid, 4-hydroxybenzoic acid, aminobenzoic acid, naphthalenedisulfonic acid, hydroxybenzenesulfonic acid, toluenesulfinic acid, benzenesulfinic acid, sulfanilic acid, sulfamic acid, α-resorcic acid, β-resorcic acid, γ-resorcic acid, gallic acid, fluoroglycine, sulfosalicylic acid, ascorbic acid, erythorbic acid, bisphenolic acid, hydrochloric acid, nitric acid, sulfuric acid, phosphoric acid, polyphosphoric acid, boric acid, and boronic acid. An amount of such acid to be added can be determined so as to obtain a surface pH of 3 to 8 for the ink receptive layer.

The acid mentioned above may be used in the form of a metal salt (such as of sodium, potassium, calcium, cesium, zinc, copper, iron, aluminum, zirconium, lanthanum, yttrium, magnesium, strontium, or cerium) or an amine salt (such as of ammonia, triethylamine, tributylamine, piperadine, 2-methylpiperadine, or polyallylamine).

The recording layer of the invention such as the ink receptive layer preferably includes a storage stability improving agent such as an ultraviolet absorber, an antioxidant, or an antiblotting agent.

Such an ultraviolet absorber, antioxidant, or antiblotting agent usable in combination can be, for example, an alkylated phenolic compound (including a hindered phenol compound), an alkylthiomethylphenol compound, a hydroquinone compound, an alkylated hydroquinone compound, a tocopherol compound, a thiodiphenyl ether compound, a compound having two or more thioether bonds, a bisphenol compound, an O—, N— or S-benzyl compound, a hydroxybenzyl compound, a triazine compound, a phosphonate compound, an acylaminophenol compound, an ester compound, an amide compound, ascorbic acid, an amine antioxidant, a 2-(2-hydroxyphenyl)benzotriazole compound, a 2-hydroxybenzophenone compound, an acrylate, a water-soluble or hydrophobic metal salt, an organometallic compound, a metal complex, a hindered amine compound (including TEMPO compound), a 2-(2-hydroxyphenyl)-1,3,5-triazine compound, a metal deactivator, a phosphite compound, a phosphonite compound, a hydroxylamine compound, a nitron compound, a peroxide scavenger, a polyamide stabilizer, a polyether compound, a basic auxiliary stabilizer, a nucleation agent, a benzofuranone compound, an indolinone compound, a phosphine compound, a polyamine compound, a thiourea compound, an urea compound, a hydrazide compound, an amidine compound, a sugar compound, a hydroxybenzoic acid compound, a dihydroxybenzoic acid compound, or a trihydroxybenzoic acid compound.

It is preferable to use, among these, at least one of an alkylated phenol compound, a compound having two or more thioether bonds, a bisphenol compound, ascorbic acid, an amine antioxidant, a water-soluble or hydrophobic metal salt, an organometallic compound, a metal complex, a hindered amine compound, a polyamine compound, a thiourea compound, a hydrazide compound, a hydroxybenzoic acid compound, a dihydroxybenzoic acid compound, or a trihydroxybenzoic acid compound, in combination.

Specific examples of the compound include those described in JP-A Nos. 2002-307822, 10-182621 and2001-260519, JP-B Nos. 4-34953 and 4-34513, JP-A No. 11-170686, JP-B No. 4-34512, EP 1138509, JP-A Nos. 60-67190, 7-276808, 2001-94829, 47-10537, 58-111942, 58-212844, 59-19945,59-46646, 59-109055, and 63-53544, JP-B Nos. 36-10466, 42-26187, 48-30492, 48-31255, 48-41572, 48-54965, and 50-10726, U.S. Pat. Nos. 2,719,086, 3,707,375, 3,754,919, and 4,220,711, JP-B Nos. 45-4699 and 54-5324, EP-A Nos. 223739, 309401, 309402, 310551, 310552, and 459416, GP-A No. 3435443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437, and 5-170361, JP-B Nos. 48-43295 and 48-33212, and U.S. Pat. Nos. 4,814,262 and 4,980,275.

Other components may be employed singly or in a combination of two or more kinds. Other components may be added in a water-soluble state, a dispersed state, a polymer dispersion state, an emulsified state, or an oil droplet state, or may be incorporated in microcapsules.

In the case of adding such an other component, the amount to be added is preferably 0.01 to 10 g/m$^2$.

The recording layer coating liquid of the invention may include a surfactant. The surfactant can be any of cationic, anionic, nonionic, amphoteric, fluorinated, and silicone surfactants. Such a surfactant may be employed singly or in a combination of two or more kinds.

The nonionic surfactant can be, for example, a polyoxyalkylene alkyl ether or a polyoxyalkylene alkylphenyl ether (such as diethylene glycol monoethyl ether, diethylene glycol diethyl ether, polyoxyethylene lauryl ether, polyoxyethylene stearyl ether, or polyoxyethylene nonylphenyl ether), an oxyethylene-oxypropylene block copolymer, a sorbitan fatty acid ester (such as sorbitan monolaurate, sorbitan monoleate, or sorbitan trioleate), a polyoxyethylenesorbitan fatty acid ester (such as polyoxyethylenesorbitan monolaurate, polyoxyethylenesorbitan monooleate, or polyoxyethylenesorbitan trioleate), a polyoxyethylenesorbitol fatty acid ester (such as polyoxyethylenesorbit tetraoleate), a glycerin fatty acid ester (such as glycerol monooleate), a polyoxyethyleneglycerin fatty acid ester (such as polyoxyethyleneglycerin monostearate or polyoxyethyleneglycerin monooleate), a polyoxyethylene fatty acid ester (such as polyethylene glycol monolaurate, or polyethylene glycol monooleate), a polyoxyethylene alkylamine, or an acetylene glycol (such as 2,4,7,9-tetramethyl-5-decin-4,7-diol, an ethylene oxide addition product or a propylene oxide addition product of such a diol), and a polyoxyalkylene alkyl ether is preferred. Such a nonionic surfactant may be contained in either of the first coating liquid and the second coating liquid.

The amphoteric surfactant can be, for example, of an amino acid type, a carboxyammonium betain type, a sulfonammonium betain type, an ammonium sulfate ester betain type, or an imidazolium betain type, and those described in U.S. Pat. No. 3,843,368 and JP-A Nos. 59-49535, 63-236546, 5-303205, 8-262742 and 10-282619 can be advantageously employed. Such an amphoteric surfactant is preferably an amino acid type amphoteric surfactant, which is derived, as described in JP-A No. 5-303205, from an amino acid (such as glycine, glutamic acid, or hystidic acid), and can be an N-aminoacyl acid having a long-chain acyl group or a salt thereof.

The anionic surfactant can be, for example, a fatty acid salt (such as sodium stearate, or potassium oleate), an alkylsulfonate ester salt (such as sodium laurylsulfonate or triethanolamine laurylsulfonate), a sulfonate salt (such as sodium dodecylbenzenesulfonate), an alkylsulfosuccinate salt (such as sodium dioctylsulfosuccinate), an alkyldiphenyl ether disulfonate salt, or an alkylphosphate salt.

The cationic surfactant can be an alkylamine salt, a quaternary ammonium salt, a pyridinium salt, or an imidazolium salt.

The fluorinated surfactant can be a compound derived through an intermediate having a perfluoroalkyl group, by electrolytic fluorination, telomerization, or oligomerization. Examples include a perfluoroalkylsulfonate salt, a perfluoroalkylcarboxylate salt, a perfluoroalkyl-ethylene oxide addition product, a perfluoroalkyltrialkyl ammonium salt, a perfluoroalkyl group-containing oligomer, and a perfluoroalkylphosphate ester.

The silicone surfactant is preferably a silicone oil denatured with an organic group, and may have a structure in which a side chain of a siloxane structure is denatured with an organic group, a structure in which both ends are denatured, or a structure in which an end is denatured. The organic group denaturing can be an amino denaturing, a polyether denaturing, an epoxy denaturing, a carboxyl denaturing, a carbinol denaturing, an alkyl denaturing, an aralkyl denaturing, a phenol denaturing, or a fluorine denaturing.

The content of the surfactant in the recording layer coating liquid is preferably 0.001 to 2.0%, more preferably 0.01 to 1.0%. Also in the case two or more coating liquids are used for coating the ink receptive layer, the surfactant is preferably added to each of the coating liquids.

In the recording layer of the invention, it is also advantageous to include a high boiling-point organic solvent in order to prevent cracking and curling, and such a high boiling-point organic solvent can be a water-soluble or hydrophobic organic compound which has a boiling point of 150° C. or higher at atmospheric pressure, which may be liquid or solid at room temperature, and which is of a high or low molecular weight.

[Recording Medium]

A recording medium of the present invention can be, for example, an ink jet recording medium, a thermal recording medium, a pressure-sensitive recording medium, a thermal transfer recording medium, or the like. The recording layer is preferably provided on one side or on both sides of a substrate. In the following, an ink jet recording medium will be explained as an example.

(Substrate)

A substrate for the recording medium of the invention can be a transparent substrate, formed from a transparent material such as plastic, or an opaque substrate formed from an opaque material such as paper. For exploiting the advantage of transparency of the ink receptive layer, it is preferable to employ a transparent substrate or an opaque substrate of high luster. It is also possible to utilize are ad-only optical disk such as a CD-ROM or a DVD-ROM, a recordable optical disk such as CD-R or DVD-R, or a rewritable optical disk as the substrate and to form the ink receptive layer on the label side.

As a material usable for the transparent substrate, a transparent material capable of withstanding heat of radiation when used in an overhead projection or a back-lit display is prefered. Such material can for example be a polyester such as polyethylene terephthalate (PET), polysulfone, polyphenylene oxide, polyimide, polycarbonate, or polyamide. Among these, a polyester is preferable, and polyethylene terephthalate is particularly preferable.

The thickness of the transparent substrate is not particularly restricted, but is preferably within a range of 50 to 200 μm to promote ease of handling.

An opaque substrate of high luster preferably has a luster of 40% or higher on a surface on which the recording layer such as an ink receptive layer is to be provided. The luster mentioned above is determined according to a method described in JIS P-8142 (test method for 75° mirror surface luster of paper and board). More specifically, the following substrates can be employed.

Examples include a paper substrate of high luster, such as art paper, coated paper, cast coated paper, or baryta paper employed as a substrate for silver halide-based photographs; a film of high luster (that may be surface calendered) made opaque by including, for example, a white pigment in a plastic film of, for example, a polyester such as polyethylene terephthalate (PET), a cellulose ester such as nitrocellulose, cellulose acetate, or cellulose acetate butyrate; polysulfone, polyphenylene oxide, polyimide, polycarbonate, or polyamide; and a substrate having a polyolefin coating layer containing or not containing white pigment on a surface of either the aforementioned paper substrate, the aforementioned transparent substrate, or a high-luster film containing white pigment.

Also, a foamed polyester film containing white pigment (for example, foamed PET in which polyolefin fine particles are contained and pores are formed by extending) is advantageous. A resin coated paper used for a photographic paper for silver halide-based photograph is also advantageous.

The thickness of the aforementioned opaque substrate is not particularly restricted but is preferably 50 to 300 μm in consideration of ease of handling.

Also, the surface of the substrate may be subjected, for improving wetting and adhesion properties, to corona discharge or glow discharge treatment, flame treatment, or treatment with ultraviolet irradiation.

The following is a detailed explanation of a base paper to be employed in producing the resin coated paper.

The base paper is milled principally from a wood pulp, and, if necessary, employing a synthetic pulp such as of polypropylene or synthetic fibers such as of nylon or polyester in addition to the wood pulp. The wood pulp can be any of LBKP, LBSP, NBKP, NBSP, LDP, NDP, LUKP, and NUKP, but it ispreferable to employ LBKP, NBSP, LBSP, NDP or LDP in a large proportion, as they are rich in short fibers.

However, the proportion of LBSP and/or LDP is preferably from 10 to 70 mass %.

As the aforementioned pulp, it is preferable to employ chemical pulp of low impurity content (such as sulfate pulp or sulfite pulp), and a pulp improved in whiteness by bleaching is also useful.

In the base paper, it is possible to appropriately add, for example, a sizing agent such as a higher fatty acid or an alkylketene dimer, a white pigment such as calcium carbonate, talc, or titanium oxide, a paper strength improving agent such as starch, polyacrylamide or polyvinyl alcohol, a fluorescent whitening agent, a moisture retaining agent such as polyethylene glycol, a dispersant, a softening agent such as a quaternary ammonium salt, etc.

The pulp used for papermaking preferably has a freeness of 200-500 ml by CSF standards, and a fiber length after beating of 30-70% being the sum in mass % of a 24-mesh residue mass % and a 42-mesh residue mass % defined in JIS P-8207. Also, a 4-mesh residue mass % is preferably 20 mass % or less.

The base paper preferably has a basis weight of 30-250 $g/m^2$, and in particular is preferably 50-200 $g/m^2$. The thickness of the base paper is preferably 40 to 250 μm. The base paper can be given a high smoothness through a calendering process during or after papermaking. The density of the base paper is generally 0.7 to 1.2 $g/m^2$ (JIS P-8118).

Also a stiffness of the base paper is preferably 20 to 200 g according to conditions defined in JIS P-8143.

The surface of the base paper may be coated with a surface sizing agent, which can be similar to the sizing agent added in the base paper.

The base paper preferably has a pH of 5 to 9, when measured with a hot water extraction method defined in JIS P-8113.

Polyethylene used for coating the top surface and the rear surface of the base paper is principally low density polyethylene (LDPE) and/or high density polyethylene (HDPE), although LLDPE, polypropylene, etc. may also be partially employed.

In particular, a polyethylene layer on the side where the recording layer such as the ink receptive layer is formed is preferably improved in opaqueness, whiteness, and hue, as is commonly executed in photographic paper, by adding a rutile or anatase titanium oxide, a fluorescent whitening agent, or ultramarine blue to the polyethylene. The content of titanium oxide in the polyethylene is preferably about 3 to 20 mass %, more preferably 4 to 13 mass %. The polyethylene layer is not particularly restricted in thickness, but is preferably 10 to 50 μm for both the top layer and the rear layer. On the polyethylene layer, an undercoat layer may be provided for providing an adhesive property to the recording layer such as ink receptive layer. This undercoat layer is preferably formed with an aqueous polyester, gelatin, or PVA. The undercoat layer preferably has a thickness of 0.01-5 μm.

A polyethylene-coated paper may be used as a paper of high luster or, by a pressing operation during the melt extrusion coating of polyethylene on the surface of the base paper, may be formed into a matted surface or silk surface as utilized in ordinary photographic papers.

The substrate may also be provided with a back coating layer, and components that can be added to this back coating layer include a white pigment, an aqueous binder, and other components.

The white pigment contained in the back coating layer can be, for example, an inorganic white pigment such as light calcium carbonate, heavy calcium carbonate, caolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrated halloycite, magnesium carbonate, or magnesium hydroxide, or an organic pigment such as a styrenic plastic pigment, an acrylic plastic pigment, polyethylene, microcapsules, urea resin, or melamine resin.

An aqueous binder to be employed in the back coating layer can be, for example, a water-soluble polymer such as a styrene/maleate salt copolymer, a styrene/acrylate salt copolymer, polyvinyl alcohol, silanol-denatured polyvinyl alcohol, starch, cationated starch, casein, gelatin, carboxymethyl cellulose, hydroxyethyl cellulose, or polyvinylpyrrolidone, or a water-dispersible polymer such as styrene-butadiene latex or acryl emulsion.

Other components that can be contained in the back coating layer include a defoaming agent, an antifoaming agent, a dye, a fluorescent whitening agent, an antiseptic, and a water resistant agent.

Also there can be employed for a substrate, if necessary, a film of high luster (that may be surface calendered) made opaque by including a white pigment in a plastic film of, for example, a polyester such as polyethylene terephthalate (PET), a cellulose ester such as nitrocellulose, cellulose acetate, or cellulose acetate butyrate; polysulfone, polyphenylene oxide, polyimide, polycarbonate, or polyamide; or a substrate having a polyolefin coating layer containing or not containing white pigment on a surface of any of the aforementioned paper substrates, the aforementioned transparent substrates, or a high-luster film containing a white pigment. Also, a foamed polyester film containing a white pigment (for example, foamed PET which is made to contain polyolefin fine particles and pores are formed by extending) may be employed.

[Preparation of Recording Medium]

In the recording medium of the invention, the ink receptive layer is preferably formed with the aforementioned recording layer coating liquid. An ink jet recording medium provided with an ink receptive layer will be now explained as an example.

The ink receptive layer is preferably formed, for example, by a method (wet-on-wet method) which involves a first coating of a substrate surface with a first coating liquid (hereinafter also referred to as "recording layer coating liquid (A)") including at least fumed silica particles and a water-soluble resin, then applying a second coating liquid which at least contains a mordant and has a pH of 7.1 or higher (hereinafter also referred to as "coating liquid (B)") either (1) simultaneously with the first coating, or (2) during the course of drying of the coated layer formed by the first coating and before the coated layer shows a decreasing drying rate, and finally hardening by crosslinking of the coated layer to which the coating liquid (B) is applied. The crosslinking agent capable of crosslinking the water-soluble resin is preferably included in at least either of the recording layer coating liquid (A) and the coating liquid (B) mentioned above.

Presence of such an ink receptive layer hardened by crosslinking is preferable for ink absorption and for prevention of film cracking.

(Preparation of Recording Layer Coating Liquid (A))

The recording layer coating liquid (A) can be prepared, for example, by adding fumed silica particles and a dispersant to water (for example, fumed fine silica particles being 10 to 20 mass % in water) and executing dispersion with ahigh-speed wet process colloid mill (for example, Clear Mix manufactured by M Technique Co.) at a high revolution speed such as 10,000 rpm (preferably 5,000 to 20,000 rpm) for, for example, 20 minutes (preferably 10 to 30 minutes) to obtain an aqueous dispersion of fumed silica particles, then adding a water-soluble resin (for example, an aqueous solution of polyvinyl alcohol (PVA) in an amount that, for example, PVA represents about ⅓ of the particles, in mass) and a crosslinking agent (for example, a boron compound, when the water-soluble resin is PVA) and executing dispersion at the same revolution speed as above. The obtained coating liquid is in a uniform solstate, and can form a porous layer having a three-dimensional network structure by coating and drying on the substrate according to the following coating method.

(Preparation of Coating Liquid (B))

The coating liquid (B) (a basic solution with a pH of 7.1 or higher) preferably contains a crosslinking agent and a mordant. The basic solution has a pH value of 7.1 or higher, preferably 8.5 or higher and more preferably 9.0 or higher. When the pH value is less than 7.1, the crosslinking agent cannot execute a sufficient crosslinking reaction of the water-soluble polymer contained in the recording layer coating liquid (A), whereby the ink receptive layer suffers defects such as cracking. The basic solution at least contains a basic substance (for example ammonia, or a primary amine (such as ethylamine, or polyallylamine), a secondary amine (such as dimethylamine or triethylamine), a tertiary amine (such as N-ethyl-N-methylbutylamine), a hydroxide of an alkali metal, an alkali earth metal, or like substrate, and/or a salt of the basic substance.

The basic solution can be prepared for example by adding, under sufficient agitation in ion-exchanged water, a polyallylamine as the basic compound (for example 1-5%), if necessary paratoluenesulfonic acid (for example 0.5-3%), and ammonium chloride (for example 0.05-2%). The percentage of each component represents mass % of solid content.

(Preparation of Recording Medium)

The foregoing expression "before the coated layer shows a decreasing drying rate" means a period of usually several minutes from immediately after the coating of the recording layer coating liquid (A), and, during such period, a "constant drying rate" phenomenon occurs in which the content of the solvent (dispersing medium) in the coated layer decreases in proportion to time. The elapsing time for this "constant drying rate" is described for example in Chemical Engineering Handbook (Kagaku Kogaku Binran) (pp.707-712, published by Maruzen, Oct. 25, 1980).

As described above, after the coating of the recording layer coating liquid (A), the coated layer is dried until it shows a decreasing drying rate, with the drying being generally executed at 40 to 180° C. for 0.5 to 10 minutes (preferably 0.5 to 5 minutes). The drying time naturally can vary depending on the coating amount, but is generally executed within the aforementioned range.

A method of application of the coating liquid (B) before the coated layer starts to show a decreasing drying rate can be, for example, 1) a method of coating the coating liquid (B) on the coated layer, 2) a method of spraying the coating liquid (B) on the coated layer, or 3) a method of immersing the substrate bearing the coated layer in the coating liquid (B).

In the above method 1), the coating liquid (B) can be coated with a known coating method, such as with a curtain flow coater, an extrusion die coater, an air doctor coater, a blade coater, a rod coater, a knife coater, a squeeze coater, a reverse rollcoater, or a barcoater. However, it is preferable to employ a method in which the coater does not contact directly with the already formed first coated layer, such as with an extrusion die coater, a curtain flow coater or a bar coater.

After the application of the coating liquid (B), drying and hardening are executed generally by heating at 40 to 180° C. for 0.5 to 30 minutes. It is preferable to execute heating at 40 to 150° C. for 1 to 20 minutes.

It is also possible to provide the coating liquid (B) simultaneously with the coating of the recording layer coating liquid (A), in which case, the ink receptive layer can be formed by simultaneously coating (superposed coating) the recording layer coating liquid (A) and the coating liquid (B) on the substrate in such a manner that the recording layer coating liquid (A) comes into contact with the substrate, followed by drying and hardening.

The simultaneous coating (superposed coating) can be achieved with a coating method utilizing for example an extrusion die coater or a curtain flow coater. After the simultaneous coating, the coated layers are dried, and drying in this case being generally executed by heating the coated layers for 0.5 to 10 minutes at 15 to 150° C., preferably for 0.5 to 5 minutes at 40 to 100° C.

When the simultaneous coating (superposed coating) is executed, for example, with an extrusion die coater, the two simultaneously discharged coating liquids are formed into superposed layers at the discharge port of the extrusion die coater, that is, before transfer onto the substrate, and are coated in this state to form a superposed coating on the substrate. The coating liquids in two layers superposed before coating tend to undergo, at the time of transfer to the substrate, a crosslinking reaction at the interface of the two liquids, thereby resulting in a mixing of the two discharged liquids at the discharged port of the coater and an increase in the viscosity, thus hindering the coating operation. Therefore, in the case of the simultaneous coating as explained above, it is preferable, together with the recording layer coating liquid (A) and the coating liquid (B), to provide a barrier layer liquid (intermediate layer liquid) between the two liquids, thus simultaneously coating three layers.

The barrier layer liquid can be selected without any particular restriction. For example it can be an aqueous solution containing a trace amount of a water-soluble resin, or water. A water-soluble resin is used, for example, as a viscosifying agent in consideration of coating ability, and can be a cellulose resin (such as hydroxypropylmethyl cellulose, methyl cellulose, or hydroxyethylmethyl cellulose), or a polymer such as polyvinylpyrrolidone or gelatin. A mordant may also be contained in the barrier layer liquid.

After the ink receptive layer is formed on the substrate, the ink receptive layer may be subjected to a calendering process by passing through a roll nip under heat and pressure in a super calender or a gloss calender for improving the surface smoothness, luster, transparency and coated film strength. This calendering process, however, may cause a decrease in the pore rate (i.e., a decrease in the ink absorbing property) and thus has to be executed under the condition of not causing a significant decrease in the pore rate.

In the calendering process, the roll temperature is preferably 30 to 150° C., more preferably 40 to 100° C. A linear pressure between the rolls during the calendering process is preferably 50 to 400 kg/cm, more preferably 100-200 kg/cm.

The ink receptive layer preferably has excellent transparency. A benchmark therefor is given by a haze value, when the ink receptive layer is formed on a transparent film substrate, of 30% or less, more preferably 20% or less. The haze value can be measured with a haze meter (HGM-2DP, manufactured by Suga Shikenki Co.).

A layer included in the structure of the recording medium of the invention (for example, the ink receptive layer) may include a polymer fine particle dispersion. A polymer fine particle dispersion is used for improvement of film properties, such as dimensional stabilization, curl prevention, prevention of adhesion, and prevention of film cracking. The polymer fine particle dispersion is described in JP-A Nos. 62-245258, 62-1316648, and 62-110066. An addition of a polymer fine particle dispersion of a low glass transition temperature (40° C. or lower) to the ink receptive layer allows prevention of such adverse effects as cracking or curling of the layer. Addition of a polymer fine particle dispersion of a high glass transition temperature to the back layer also allows prevention of curling.

EXAMPLES

Examples will next be shown for clarifying the present invention in more detail, but the present invention is not limited to these examples. In the following, "part" and "%" will be taken to respectively mean "part by mass" and "mass %".

Example 1

(Preparation of Substrate)

Wood pulp, made with LBKP, was adjusted to a Canadian freeness of 300 ml with a disk refiner. To the obtained pulp slurry were added cationic starch (CATO 304L, manufactured by Nippon NCS Co.) in an amount of 1.3% with respect to the pulp, anionic polyacrylamide (Polyacron ST-13, manufactured by Seiko Kagaku Co.) in an amount of 0.145%, alkylketene dimer (Size Pine K, manufactured by Araki Kagaku Co.) in an amount of 0.285%, epoxylated behenate amide in an amount of 0.285%, and polyamide polyamine epichlorohydrin (Arafix 100, manufactured by Araki Kagaku Co.) in an amount of 0.2%. And a defoaming agent was added thereafter.

The pulp slurry, thus prepared, was milled on a long-screen paper mill into a web, which was dried by pressing a surface to be coated with the recording layer under a dryer canvas to a drum dryer cylinder, after which the prepared paper was coated on both surfaces with polyvinyl alcohol (KL-118, manufactured by Kuraray Co.) in an amount of 1 g/m$^2$ on a size press, dried, and subjected to a calendering process. The prepared paper was prepared with a basis weight of 166 g/m$^2$ to obtain a base paper of a thickness of 160 μm.

A wire side (rear surface) of the obtained base paper was subjected to corona discharge treatment and was coated with a high density polyethylene using a melt extruder so as to obtain a thickness of 25 μm, whereby a resin layer of a matted surface was formed (hereinafter the surface having the resin layer is referred to as "rear surface") The resin layer on the rear surface was further subjected to corona discharge treatment, and as an antistatic agent, a dispersion formed by dispersing aluminum oxide (Alumina Sol 100, manufactured by Nissan Chemical Industries Co.) and colloidal silicon dioxide (Snowtex O, manufactured by Nissan Chemical Industries Co.) in water in a ratio (mass ratio) of 1:2 was coated so as to obtain a dry mass of 0.2 g/m$^2$.

Then, a felt side (front surface) not having the resin layer was subjected to corona discharge treatment, after which a low density polyethylene of an MFR (melt flow rate) of 3.8, which contained anatase type titanium dioxide in a content of 10%, ultramarine blue manufactured by Tokyo Ink Co. in an amount of 60 mg/m$^2$ and a fluorescent whitening agent "Whiteflour PSN conc" manufactured by Nippon Kagaku Kogyosho Co. in an amount of 13 mg/m$^2$, was melt extruded by a melt extruder so as to obtain a thickness of 25 μm and thereby form a thermoplastic resin layer of high luster on the front surface of the base paper (this high luster surface being referred to hereinafter as "front surface"), thus completing formation of a substrate.

(Preparation of Recording Layer Coating Liquid (A))

In the following formulation, 1) fumed fine silica particles, 2) ion-exchanged water, 3) "Shalol DC-902P (cationic resin dispersant)", and 4) "ZA-30" were mixed and a beads mill KD-P (manufactured by Shin-maru Enterprises Ltd.) was used to obtain a fumed silica particle dispersion. Then 5) "Superflex 600B", and 6) polyvinyl alcohol aqueous solutions were added (in the order of (1) and (2) indicated below), and next 7) boric acid and 8) polyoxyethylene lauryl ether were added and dissolved, after which mixing was executed for 30 minutes at 1400 rpm to obtain a recording layer coating liquid (A).

The fumed fine silica particles and the polyvinyl alcohol (water-soluble resin) had a mass ratio (PB ratio) of 4.5:1, and the recording layer coating liquid (A) had an acidic pH value of 3.5.

| <Formulation of recording layer coating liquid (A)> | |
|---|---|
| 1) fumed fine silica particles (specific surface area: 300 m$^2$/g, bulk density: 75 g/l) (VP300SV, manufactured by Nippon Aerosil Co.) | 10.0 parts |
| 2) ion-exchanged water | 45.3 parts |
| 3) Shalol DC-902P (cationic resin dispersant) (51.5% aqueous solution, manufactured by Dai-ichi Kogyo Seiyaku Co.) | 1.0 part |
| 4) ZA-30 (mordant, manufactured by Dai-ichi Kigenso Kogyo Co.) | 0.5 parts |
| 5) Superflex 600B (mordant, manufactured by Dai-ichi Kogyo Seiyaku Co.) | 2.5 parts |
| 6) water-soluble resin | |
| polyvinyl alcohol 7% aqueous solution (1) (PVA224, saponification degree: 88%, polymerization degree: 2,400, manufactured by Kuraray Co.) | 31.7 parts |
| polyvinyl alcohol 8% aqueous solution (2) (PVA405, saponification degree: 80%, polymerization degree: 500, manufactured by Kuraray Co.) | 9.9 parts |
| 7) boric acid (crosslinking agent) | 7.2 parts |
| 8) polyoxyethylene lauryl ether (surfactant) (Emulgen 109P (10% aqueous solution), HLB value: 13.6, manufactured by Kao Corp.) | 0.28 parts |

(Preparation of Coating Liquid B)

The following components were mixed and dissolved to obtain a coating liquid (B):

| | |
|---|---|
| boric acid (crosslinking agent) | 0.31 parts |
| AC-7 (mordant) (manufactured by Dai-ichi Kigenso Co.) | 1.4 parts |
| ion-exchanged water | 40.7 parts |
| ammonium carbonate (surface pH regulating agent) | 0.72 parts |
| polyoxyethylene lauryl ether (surfactant) (Emulgen 109P (2% aqueous solution), HLB value: 13.6, manufactured by Kao Corp.) | 4.8 parts |
| fluorinated surfactant (Megafac F1405 (10% aqueous solution), manufactured by Dai-Nippon Inks and Chemicals, Inc.) | 0.10 parts |

(Preparation of Recording Medium)

After the front surface of the aforementioned substrate was subjected to corona discharge treatment, the recording layer coating liquid (A) obtained as described above was coated on the front surface of the substrate with an extrusion die coater in a coating amount of 175 ml/m$^2$ (coating process), and was dried with a hot air dryer at 80° C. (air speed: 3 to 8 m/sec) until the coated layer reached a solid content of 20%. During this period, the coated layer showed a constant drying rate. Immediately thereafter, it was immersed in the coating liquid (B) for 30 seconds thereby depositing the coating liquid in an amount of 15 g/m$^2$ (mordant solution application process), and was further dried for 10 minutes at 80° C. (drying process). Thus a recording medium was prepared provided with an ink receptive layer of a dry thickness of 32 μm.

Example 2

A recording medium was prepared in the same manner as in Example 1, except that the "VP300SV" fumed fine silica particles employed therein were replaced with "Aerosil 300V" manufactured by Nippon Aerosil Co.

Comparative Example 1

A recording medium was prepared in the same manner as in Example 1, except that the "VP300SV" fumed fine silica particles employed therein were replaced with "Aerosil 200V" manufactured by Nippon Aerosil Co.

Comparative Example 2

A recording medium was prepared in the same manner as in Example 1, except that the "VP300SV" fumed fine silica particles employed therein were replaced with "Aerosil 300" manufactured by Nippon Aerosil Co.

Comparative Example 3

A recording medium was prepared in the same manner as in Example 1, except that the "VP300SV" fumed fine silica particles employed therein were replaced with "Rheolosil QS-30" manufactured by Tokuyama Corp.

[Viscosity Measurement of Recording Layer Coating Liquid (A)]

For the recording layer coating liquid (A) containing the fumed fine silica particles, a viscosity measurement was conducted with a Brookfield viscosimeter after 1 day from the preparation of the recording layer coating liquid (A). The viscosity is represented in units of mPa.s.

[Recording on Recording Medium and Evaluation]

(1) Measurement of Image Density (Dm)

On each recording medium of the Examples and the Comparative Examples, a solid black image was printed with a PM-900C ink jet printer (manufactured by Seiko-Epson Ltd.) and a density of the obtained black area was measured with a reflective densitometer (Xrite 938, manufactured by Xrite Inc.). A Dm value of 2.2 or higher represents a preferable density for practical use.

(2) Ink Offset Property

Immediately after ink deposition with the inkjet printer described in (1), a paper sheet was manually brought into contact with the ink-deposited surface, and ink offsetting onto the paper sheet was visually judged as follows:

G1: no ink offsetting

G2: slight ink offsetting observed

G3: ink offsetting observed.

(3) Image Luster

Image luster was evaluated in the following manner.

Each ink jet recording medium was mounted in the sheet feeding portion of a PM-900C ink jet printer (manufactured by Seiko-Epson Ltd.) and a square solid image of 3×3 cm was printed with black color ink made specifically for the PM-900C ink jet printer. The lusters of the thus obtained black prints were visually evaluated according to the following criteria:

G1: satisfactorily high luster

G2: somewhat inferior luster to G1

G3: unsatisfactory low luster.

Results of measurement of the viscosity, the image density, the ink offset property, and the image luster of the recording layer coating liquids (A) are shown in Table 1.

TABLE 1

| | | Ex. 1 | Ex. 2 | Comp. Ex. 1 | Comp. Ex. 2 | Comp. Ex. 3 |
|---|---|---|---|---|---|---|
| fumed fine silica particles | type | VP 300SV | Aerosil 300V | Aerosil 200V | Aerosil 300 | Rheolosil QS-30 |
| | specific surface area (m$^2$/g) | 300 | 300 | 200 | 300 | 300 |
| | bulk density (g/l) | 75 | 75 | 100 | 44 | 50 |
| viscosity of coating liquid (A) | | 150 | 160 | 150 | 250 | 125 |
| image properties | image density | 2.18 | 2.20 | 2.15 | 2.20 | 2.10 |
| | ink offset property | G1 | G1 | G2 | G1 | G3 |
| | image luster | G1 | G1 | G2 | G1 | G1 |

As will be apparent from the results shown in Table 1, fumed fine silica particles meeting the conditions of "a bulk density higher than 50 g/l and a specific surface area by the BET method of 250 $m^2/g$ or higher" according to the invention exhibit a low viscosity in the recording layer coating liquid (A) thereby realizing satisfactory ease of handling, and also provide satisfactory image properties, being image density, ink offset, and luster.

On the other hand, Comparative Example 3 employing fumed fine silica particles of a bulk density of 50 g/l showed a low viscosity in the recording layer coating liquid (A) but was inferior in the image density and ink offset property. Also, Comparative Example 1 employing fumed fine silica particles of a bulk density of 100 g/l showed an insufficient image luster.

What is claimed is:

1. A recording medium including a substrate and a recording layer, wherein the recording layer comprises a water-soluble polyvinyl alcohol resin and fumed silica having a bulk density of 60 g/l or more and a specific surface area by the BET method equal to or higher than 250 $m^2/g$.

2. The recording medium according to claim 1, wherein the fumed silica has a bulk density within a range of 60 to 80 g/l.

3. The recording medium according to claim 1, wherein the fumed silica has a specific surface area by the BET method within a range of 300 to 400 $m^2/g$.

4. The recording medium according to claim 1, wherein the recording layer is an ink receptive layer for accepting an ink jet recording ink.

5. The recording medium according to claim 1, wherein the content of the water-soluble resin in the recording layer is within a range of 9 to 40 mass % with respect to a solid content (by mass) of the recording layer.

6. The recording medium according to claim 1, wherein the fumed silica (x) and the water-soluble resin (y) have a mass content ratio (PB ratio (x/y)) within a range of 1.5 to 10.

7. The recording medium according to claim 6, wherein the fumed silica (x) and the water-soluble resin (y) have a mass content ratio (PB ratio (x/y)) within a range of 2 to 5.

8. The recording medium according to claim 1, wherein the water-soluble resin is crosslinked.

9. The recording medium according to claim 8, wherein the water-soluble resin is a polyvinyl alcohol resin and is crosslinked with a boron compound.

10. A process for producing the recording medium according to claim 1, the process comprising:

coating a coating liquid for a recording layer on a substrate to form a coated layer, the coating liquid comprising at least fumed silica having a bulk density of 60 g/l or more and a specific surface area by the BET method of 250 $m^2/g$ or higher and a water-soluble resin, and forming a recording layer by hardening through crosslinking of the coated layer, wherein the hardening through crosslinking is executed by adding a crosslinking agent to the coating liquid for the recording layer and/or to a basic solution having a pH value of 7.1 or higher and by providing the coated layer with the basic solution either (1) simultaneously with formation of the coated layer formed by coating of the coating liquid for the recording layer; or (2) in the course of drying of the coated layer formed by coating the coating liquid for the recording layer and before the coated layer shows a decreasing drying rate.

11. The process for producing the recording medium according to claim 10, wherein the water-soluble resin is a polyvinyl alcohol resin and the crosslinking agent is a boron compound.

12. The process for producing the recording medium according to claim 10, wherein the recording layer is an ink receptive layer for accepting an ink jet recording ink.

* * * * *